US006203443B1

(12) United States Patent
Britton

(10) Patent No.: US 6,203,443 B1
(45) **Date of Patent: *Mar. 20, 2001**

(54) GOLF PUTTER

(75) Inventor: Richard Britton, Newport Beach, CA (US)

(73) Assignee: JRD Golf, LLC, Newport Beach, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/165,715

(22) Filed: Oct. 2, 1998

(51) Int. Cl.[7] ..... A63B 53/06; A63B 53/08; A63B 53/02; A63B 69/36

(52) U.S. Cl. ..... 473/244; 473/246; 473/288; 473/313; 473/340; 473/245

(58) Field of Search ..... 473/324, 325, 473/334, 335, 336, 337, 338, 339, 340, 341, 342, 349, 350, 288, 245, 251, 246, 248, 244, 313

(56) References Cited

U.S. PATENT DOCUMENTS 2,056,335 * 10/1936 Wettlaufer .
2,530,446 * 11/1950 Beardsley .
2,781,197 * 2/1957 Wiley .
3,368,812 * 2/1968 Baldwin .
3,567,228 * 3/1971 Lynn .
3,749,408 * 7/1973 Mills .
4,121,832 * 10/1978 Ebbing .
4,422,638 * 12/1983 Tucker .
4,618,149 * 10/1986 Maxel .
4,804,188 * 2/1989 McKee .
4,869,507 * 9/1989 Sahm .
4,884,808 * 12/1989 Retzer .
5,332,214 * 7/1994 Tucker .
5,437,447 * 8/1995 Rigutto .
5,482,282 * 1/1996 Willis .
5,509,660 * 4/1996 Elmer .

* cited by examiner

*Primary Examiner*—Sebastiano Passaniti
(74) *Attorney, Agent, or Firm*—Harry G. Weissenberger, Esq.

(57) ABSTRACT

A golf putter is provided having improved performance and custom adjustability. The putter has an adjustable-lie raised hosel which can be adjusted for a particular golfer, yet which may be semi-permanently fixed in position so that no adjustment can be readily made or worked loose during a round of golf play. To this end, the hosel has two members which are pivotally joined at a joint which includes a shaped sleeve mounted onto a projection attached to one hosel member and received in a shaped bore connected to the other hosel member. Rotation of the sleeve with respect to the projection and the bore results in an adjustment of the lie angle. Also, the putter has a sole sensor shaped to permit rocking on the ground in a lie-varying direction. Further, the putter includes a multiple replaceable and striking face plates for providing various lofts. Various weights are provided which attach to a rear of the selected face plate. The putter has improved sight aligning features, including vertically-stepped sight lines.

1 Claim, 4 Drawing Sheets

GOLF PUTTER

BACKGROUND OF THE INVENTION

The present invention generally relates to a golf putter. More specifically, the present invention relates to a putter having multiple fixed lie angles or an adjustable-lie position hosel, an interchangeable and weighted striking face plate for providing various lofts and weights, a sole shape facilitating loft lie and directional alignment while resting on the ground and improved "swale sight system" with set-up alignment and sighting features.

Putting performance is greatly dependent on a golfer's ability to precisely align and aim the club head relative to the ball path and hole. Therefore, a goal in putter design has been to provide sighting aids which assist a golfer in achieving correct alignment and optimum aim.

Proper club alignment is desired in lie, loft, striking direction, centering of the ball relative to the club head "sweet spot" and parallel-to-the-ground striking point on the club face. These terms, as used herein, have meanings conventional in golf: "lie" is an angle between a heel-to-toe line and an axis of the shaft; "loft" is an angle of the striking face plane from vertical; "striking direction" a vector parallel to the ground and which is 90° from the striking face; "sweet spot" is the optimum striking point between the club head and ball which creates correct distance and direction.

In order to assist a golfer to visually align a putter head, club heads are known to have visual markings. In a textbook putting stance, a golfer's eyes should be generally looking vertically downward over a centerline of the putter head. Thus, visual markings are generally designed to help a golfer align the club from this perspective. Much study has been directed toward attempts to improve a putter's ease of visual alignment. For example, U.S. Pat. No. 4,136,877 relates to a putter having markings on two vertical levels, the alignment of the markings indicating whether the club head is level.

Currently-available putters include sight lines that extend along the top of the putter head. While these sight lines extend along the target direction, they do not take into account the loft of the putter. That is, sight lines are not perpendicular to the face of the putter but only perpendicular to a vertical plane. Accordingly, because most putters have a loft ranging from 2° to 5°, the sight lines are not truly perpendicular to the face of the putter. It has been found that this lack of a perpendicular relationship between the face of the putter and the sight line is a disadvantage and can lead to less accurate putting. This problem is compounded when putters are equipped with a rearwardly extending flange. The top surface of the flange is typically lower than the top surface of the portion of the putter head adjacent to the striking face. As a result, if sight lines are provided on the rearwardly extending flange, they are not connected to the sight lines disposed on top of the putter head but are generally parallel to and disposed below the sight lines provided on top of the putter head. Because these sight lines too are generally not perpendicular to the striking face, the golfer has two parallel sets of sight lines to look at, neither of which are perpendicular to the striking face. Again, this combination has been found to be a great disadvantage that leads to putting inaccuracy.

Because golfers vary in body size and proportion, optimum club fit varies from person to person. The angle of the club head relative to the shaft, or "lie," is one such design aspect which must be determined for each golfer. Therefore, for a custom fit, it is desirable to provide a hosel which provides multiple fixed lie angles or adjustability of the lie.

Adjustable-lie putters, although rare, have previously been attempted. One known type has a ball-and-socket structure integral to a heel of the putter head to which the shaft is attached. By rotating the shaft, a screw mechanism loosens and tightens the ball in the socket at a selected orientation. The "Sprague Patent Putter," circa 1903, and a "Zebra" putter, circa 1970, each incorporate such a feature. Another known adjustable-lie putter known as a "Select-A-Putt," U.S. Des. Pat. No. 205,672 has an expandable friction lock between the shaft and putter head at an apex of the center and face of the putter head. A putter known as the "Barnes Patent Putter", made around the early or mid-1920's, has a locking tooth mechanism between the shaft and putter head, located at an apex of the heel and face of the putter head. That system permits lie adjustment in only a few finite increments.

Unfortunately, the USGA rules forbid readily adjustable putters. Specifically, " . . . forms of adjustability are permitted in the design of a putter, provided that: (i) the adjustment cannot be readily made; (ii) all adjustable parts are firmly fixed and there is no reasonable likelihood of them working loose during a round . . . " *USGA Rules of Golf*, Rule 4-1a (1995) (in pertinent part). The USGA interpreted this rule as prohibitive of an arrangement which was merely utilized friction tightened by a set screw. It is desirable to provide a putter with an adjustable-lie hosel which is permissible for play within the USGA rules of golf.

Putters are conventionally designed so that the striking face has a slight loft. A putter's loft generally ranges from 2–5°, but loft may be greater or smaller, if desired. Such loft slightly lifts the ball from the green during initial contact with the putter. Such a lifting effect is, in general, usually desirable so that the ball achieves momentum in the desired direction while overcoming resistance from the turf. Without any loft, or with a negative loft, the ball may push into the turf, slowing the putt, possibly causing it to react off of the turf in an undesired direction.

Putting greens have varying characteristics. Greens may vary in softness, dampness, length and texture of grass, all factors which may effect a putt. Any one particular green may experience changed characteristics even during a day. For a particular golfer, geographic region, or differing putting green characteristics, a particular putting face may result in better control and accuracy. Therefore, it is desirable to provide a putter having a selectable putting face material, loft, profile, color, sound, reflex, vibrational feedback and/or feel.

Also, weight distribution is another important aspect of putter design. Much study has been directed to placement of concentrated weights in putters. It is desirable to provide a putter head which is weighted for optimal putter feel and swing balance, as well as putting distance, control and accuracy. Also, as with other putter features, it may be desirable that such weights be adjustable in amount.

Also, the bottom surface of many putters includes a simple rectangular or arcuate configuration. Thus, the putter can "rock" or "glitch" on the putting surface as the golfer lines up the putt. As a result, the putter head can be difficult to aim easily or improperly tilt toward or away from the golfer which will adversely affect alignment and accuracy.

Finally, many putters include a hosel which is connected to the putter head at an angle. This angled connection between the putter head an the shaft also contributes to the tendency of the golfer to misalign the putt.

Thus, there is a need for an improved putter which addresses at least some, if not all of the above deficiencies including an easy way to adjust the lie of the putter, the weight and weight distribution of the putter head, the loft of the putter, face and material improved ways to visually align the striking face and improve ways to properly ground the putter.

SUMMARY OF THE INVENTION

In order to provide an improved golf putter, a putter includes an adjustable-lie hosel intended to provide adjustable components which are "firmly fixed" so that there is "no reasonable likelihood of them working loose during a round" and for which adjustments "cannot be readily made" within the meaning of the aforementioned USGA Rule.

The adjustable hosel can be provided in multiple fixed lies or with adjustable lie for an optimum custom fit to an individual golfer, facilitating easier alignment, aim and accuracy. To this end, a first hosel section or member extends generally upwardly from the putter head. The first hosel section is connected to a second hosel section which, in turn, is connected to the putter shaft. The connection between the first and second hosel sections is made at a hosel joint which permits the angle between the upwardly protruding first hosel section and the second hosel section, or the lie of the putter, to be adjusted.

The hosel joint includes a shaped bore that is connected to either the first or second hosel section. The other hosel section includes a shaped and tapered projection which fits into a shaped and slightly tapered sleeve. Both the projection and the sleeve are received in the shaped bore in a tight, press fit manner.

In an embodiment, the tapered projection includes a threaded hole for receiving a screw which extends through an opposing end of the shaped bore and is used to tighten the fit between the shaped projection, shaped sleeve and shaped bore.

In an embodiment, the shaped bore is disposed on top of the first hosel section in a cylindrical housing. The shaped bore includes three pairs of opposing landings that form a slightly irregular hexagonal shape. The shaped and tapered projection is connected to the second hosel member and also includes three pairs of diametrically opposed and tapered surfaces. Thus, the tapered projection also forms a slightly irregular and tapered hexagonal shape. The sleeve is also shaped to cooperate with the shape of the tapered projection and the shaped bore. Accordingly, it also includes a slightly irregular hexagonal and tapered shape with three pairs of diametrically opposed surfaces, pair of opposing flat surfaces and two pairs of opposing hex-angled lo-bed surfaces.

Each pair of diametrically opposed surfaces on the sleeve positions the fit between the first and second hosel section to a prescribed lie angle. For example, when a hexagonally shaped sleeve, projection and bore are employed, the sleeve permits three different lie angles such as 10°, 11° and 12°. By rotating the sleeve on the shaped projection by a single surface or ⅙ of a turn, the lie angle is changed. By rotating the sleeve by a second surface or a second ⅙ of a turn, the lie angle is changed a second time. Thus, when a hexagonally shaped projection, sleeve and bore are employed, three different lie angles are possible. In the event a hexagonally shaped projection, sleeve and bore are employed, more than one sleeve may be provided with the putter to thereby enable the golfer to change the lie angle by a greater amount. For example, if it is desired to permit adjustment of the lie angle from 10° to 22°, or a span of 12°, four different hexagonally shaped sleeves, each providing 3° of adjustment, can be provided. If differently shaped projections, sleeves and bores are employed, such as square-shaped or such as octagonally-shaped, the sleeves will provide different degrees of variance. For example, a sleeve with an irregular square-shaped cross section provides two opposing pairs of landing surfaces and therefore two different lie angles. A sleeve with an octagonally-shaped cross section includes four opposing pairs of landing surfaces and therefore four different lie angles.

Further, in an embodiment, the putter of the present invention includes a hosel connection that promotes proper alignment. A flat front face of the hosel is parallel to the face plate, which therefore promotes proper alignment. The horizontal sections of hosel connection are disposed parallel to the ground when the club is soled properly to also promote proper alignment. Further, a tapered portion of the hosel connection is angled in such a way as to lead the hands through the stroke, thereby providing a "trailor" effect when the stroke is performed properly.

According to an aspect of the present invention, the present invention provides a putter with removable and interchangeable face plates. Each plate defines a striking face, and a kit may be provided in which the plates have various materials or insert materials, lofts, profiles, sounds, reflexes, colors, vibrational feedbacks and/or feel.

In an embodiment of the invention, the putter head has a hollow cavity behind the removable face plate. A weight is secured to the inside of the face plate so that the weight is received within the cavity. The weight is removable and may be interchanged with other weights for a custom feel.

According to another aspect of the invention, a golf putter is provided wherein a sole of the putter head has a sole sensor, elevating the putter bottom. The sole sensor is a part of the bottom which projects generally downwardly and forms a flat surface. This flat surface is adapted to support the putter in a level orientation or "home" position that is parallel to the green surface so that a golfer can tactilly feel the flat portion of the sensor flatly disposed against the ground.

The sole sensor has a generally circular, spherical edge. The edge may be a continuous circle or, in an embodiment, the sole sensor may have one flat side disposed adjacently toward a striking face of the putter so that the sole sensor is generally D-shaped. When supported on the sole sensor, the putter is rockable in any direction on the circular edge, or on the flat edge portion. A golfer can feel the "home" position, and therefore is better able to vary his overall putter lie or loft with accuracy while aiming a putt.

A still further aspect of the present invention is a sight or visual alignment system which is an improved sighting feature for a golf putter. Specifically, the putter head is provided with a stepped top having at least two upper surfaces with different vertical heights. A concave "swale" or rounded channel is formed generally centrally in the upper surfaces and extends perpendicularly rearwardly from the striking face. This swale has a width approximately equal to the diameter of a golf ball. One or more central sight lines extend along the striking direction, centrally over at least two of the upper surfaces, such as through a top surface of the putter and through a top surface of the rearward flange. It has been found that maintaining the sight line at a perpendicular angle with respect to the striking face provides for greater putting accuracy. Thus, in a preferred embodiment, sight lines are perpendicular to the striking face, and take into account the loft angle of the striking face. Thus, the sight lines are not necessarily perpendicular to the ground, but are perpendicular to the lofted striking face.

The swale promotes automatic centering of the ball adjacent to the face plate center point. The swale low point is aligned nearly exact at the equator of the ball during soling and set-up for the putting stroke. During the strike motion, the club is lifted from the ground and the club head mass strikes the ball slightly below the ball's equator creating optimum gear effect on the ball, maximizing smooth ball roll with minimum skip.

Therefore, an advantage of the present invention is to provide a putter having an adjustable lie yet which is permissible within the rules of golf.

Another advantage of the present invention is to provide a putter having a plurality of interchangeable face plates having different materials, inserts, lofts, profiles, sounds, reflexes, colors, vibrational feedbacks and/or feel.

A further advantage of the present invention is to provide a putter having an improved and adjustable weight distribution.

A still further advantage of the present invention is to provide a putter having improved visual alignment markings.

Yet another advantage of the present invention is to provide a putter head with a sole shaped to rockably permit lie and loft adjustments as it rests on the green. A golfer can then raise the head weight mass nearer the center of the ball at impact, thus promoting smooth ball roll.

An additional advantage is to provide a putter having improved visual alignment aids.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
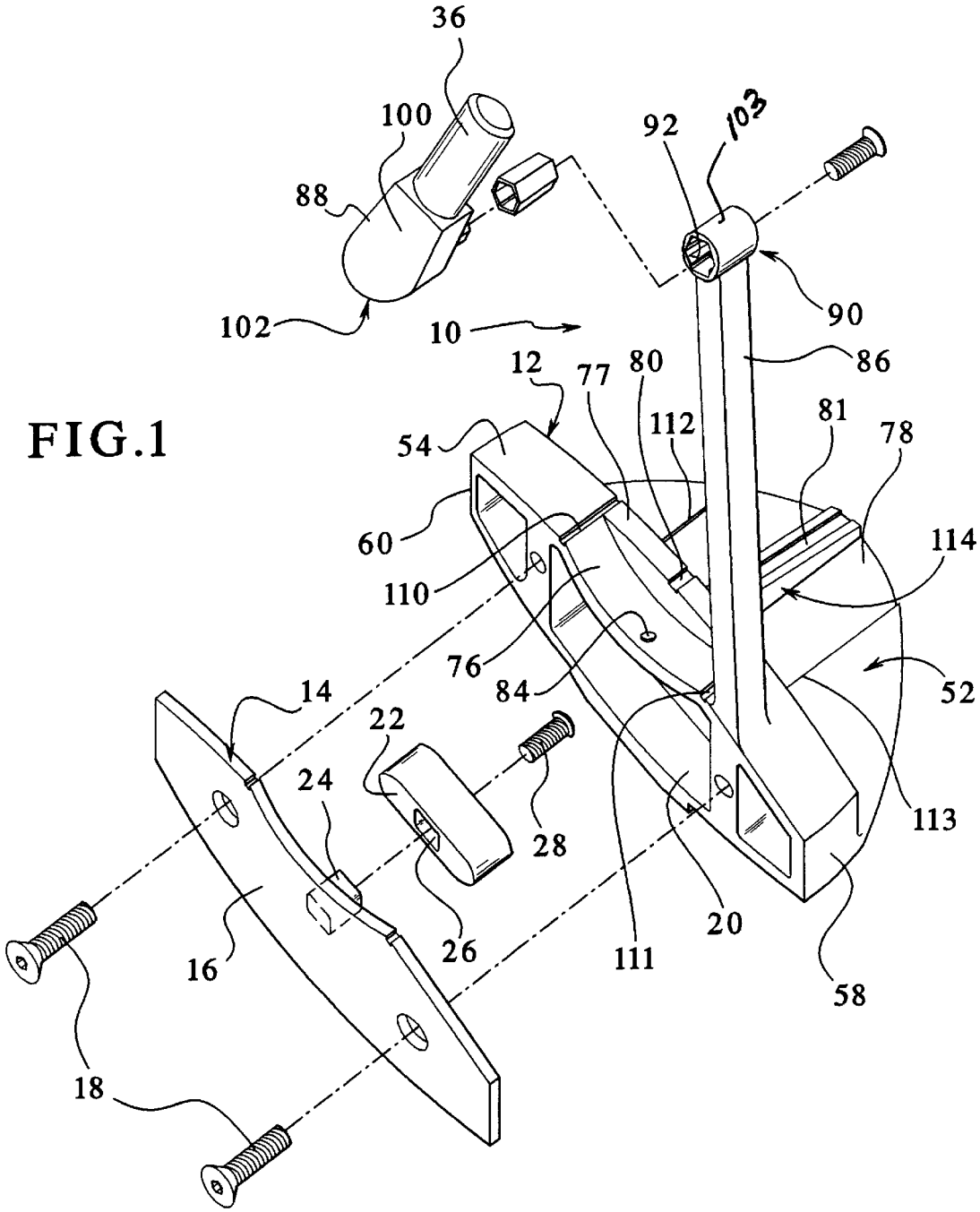
FIG. 1 is a fragmentary exploded perspective view of a putter according to the present invention.

Now turning to the drawings, FIG. 1 illustrates a putter 10 according to the invention having a putter head 12. In an embodiment of the invention, the putter 10 has a removable and interchangeable striking face plate 14. The face plate 14 defines a striking face 16 for striking a golf ball. The striking face 16 has a predetermined loft, angle, or profile from vertical.

The face plate 14 is securable to the putter head by screws 18. The screws 18 preferably have flat heads which lie flush with the striking face 16 upon tightening.

In order to provide a golfer a selection of lofts, the putter 10 may be provided as a kit including multiple interchangeable face plates 14 having various lofts, profiles, materials, vibrational feedback, sounds, colors, patterns, shapes, textures and surfaces. For example, a putter kit may include interchangeable face plates having various profiles and various possible lofts ranging from negative to positive loft angles. Preferred putter lofts typically range from 2–6°. One possible profile is a special low-loft putter face plate having a 2° loft and a rounded lower face.

Still referring to FIG. 1, the putter 10 may further include a variable weighting system. The putter head 12 includes a hollow cavity 20 which can occupy a weight 22. The weight 22 is securable to a rear of the face plate 14.

Facilitating this, a peg 24 extends from the rear of the face plate 14, and the weight has a hole 26 shaped to fit onto this peg 24. Preferably, the peg 24 and cooperatively shaped hole 26 have a square shape, or other non-round shape, which prevents the weight 22 from turning. A screw 28 extends through the weight 22 and axially into the peg 24 to secure the weight 22. Various weights 22 may be provided so that a golfer can customize the weighting of the putter 10.

As illustrated in FIG. 1, this system allows the mass of the weight 22 to be located directly behind the ball impact zone of the face plate. This weighting system promotes maximum rebound and reflex which correspondingly minimizes physical exertion of the golfer, resulting in easier putting with better control.

The weight 22 is preferably to be provided so that the putter head has an overall mass of 295 grams to 350 grams, although any desired weight size may be used. The overall weight distribution of the putter in the face, sole, heel and toe promotes a "pendulum" swing feel, during the stroke, maximizing one line stroke transmission and minimizing off center hits.

As shown in FIGS. 1–4, 5 and 11, the putter head 12 is preferably shaped to have a rearwardly-extending flange 52, a top surface 54, an elevated bottom 56, a heel 58 and a toe 60.

Figure 2:
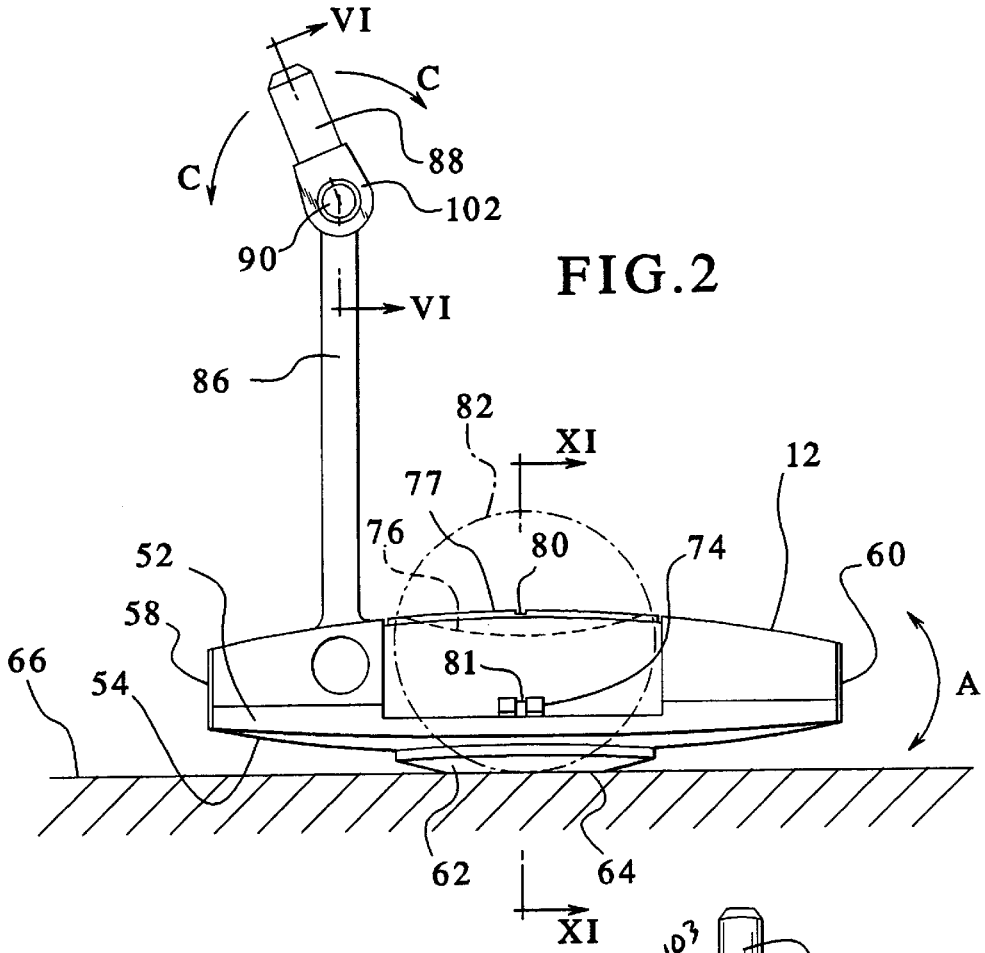
FIG. 2 is a rear view of the putter according to the invention.
Figure 3:
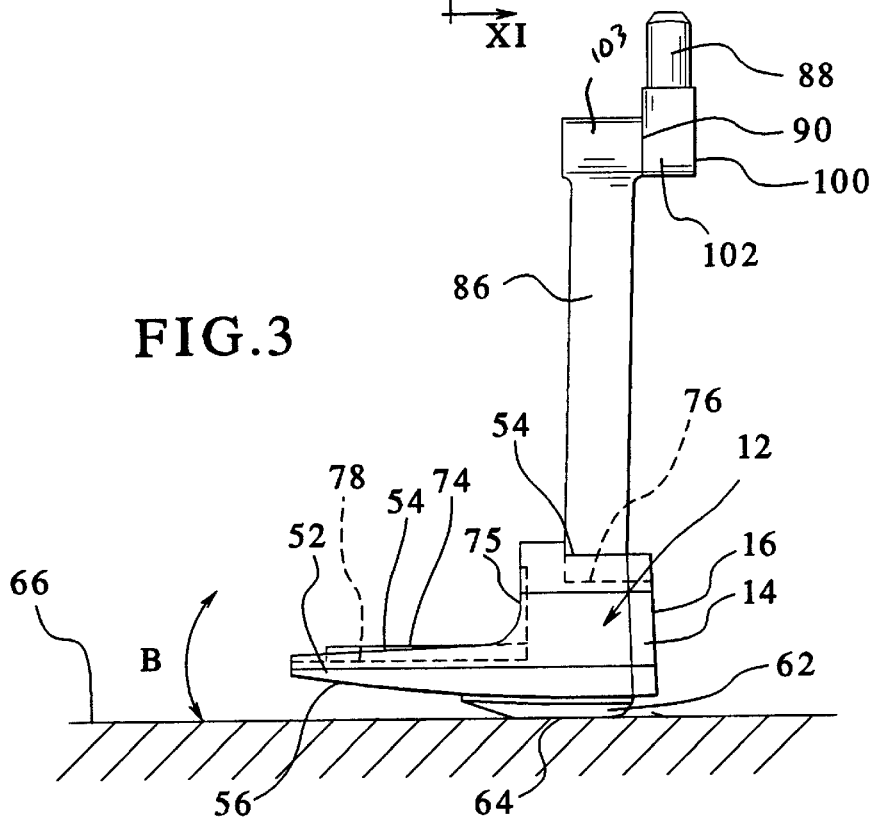
FIG. 3 is a toe or side view of the putter of FIG. 2
Figure 4:
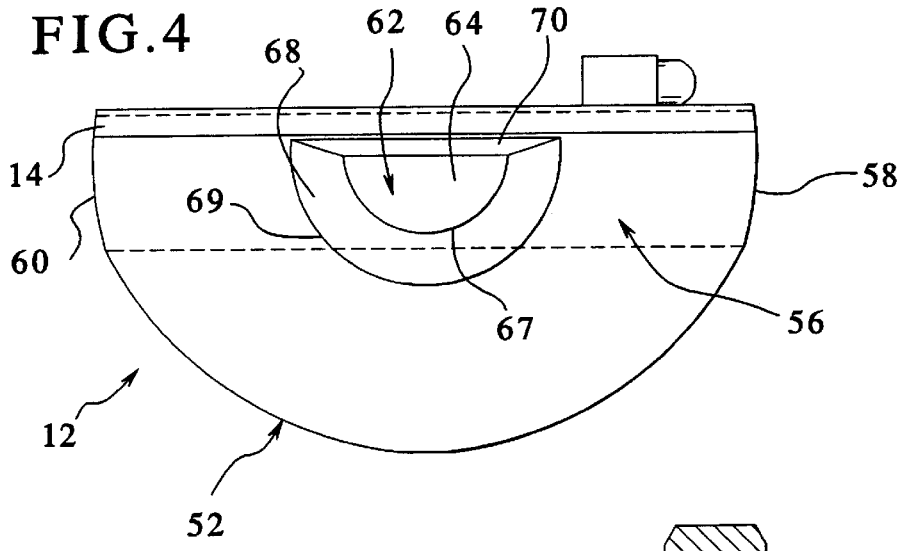
FIG. 4 is a sole or base view of the putter of FIG. 2.

Now referring to FIGS. 2–4, in an embodiment of the putter head 12, the elevated bottom 56 has a sensor 62. This sole sensor 62 is a generally downward projection of the elevated bottom 56 which forms a flat sensor surface 64 which can support the putter 12 on the ground 66. This arrangement gives the putter head 12 an elevated bottom. When the flat surface 64 rests flatly against the ground 66, the putter 10 is in a "home" position, which can be tactilly sensed by a golfer holding the grip. In the home position, shown in FIGS. 2 and 3, the putter 10 is oriented in a level position relative to the ground and which corresponds to a design-estimated optimal position of loft and lie and level.

A golfer may sometimes wish to align the putter 10 in a non-"home" position for a particular putting condition. The radial sole sensor 62 permits a rocking of the putter head 12 against the ground in any direction to a comfortable selected position.

Figure 6:
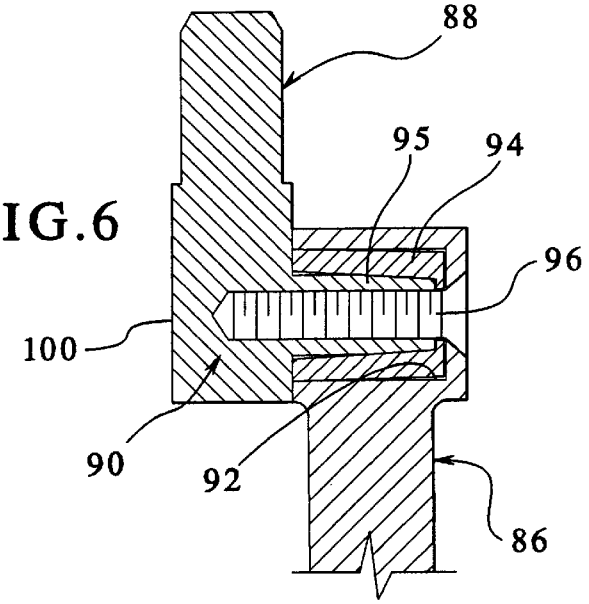
FIG. 6 is a fragmentary sectional view through an adjustable hosel joint taken generally along line VI—VI of FIG. 3.

To permit this rocking, in the embodiment illustrated in FIGS. 2, 3 and 6, the sole sensor 62 is partially circular in shape, having a spherically rounded circular edge 68, except for a rounded straight edge 70 near and parallel to the face plate 14. In other words, the sole sensor 62 is generally D-shaped. Thus, the putter head 12 may be rocked on the spherical circular edge 68 from the home position to adjust a lie orientation, as indicated by arrows A in FIG. 2. Moreover, because the sole sensor 62 does not extend to a rear of the putter bottom 56, the putter head 12 may be easily rocked on the spherical circular edge 68 or rounded straight edge 70 from the home position to adjust a loft orientation, as indicated by the arrows B in FIG. 3. Additionally, the radial sole design allows the golfer to make minute aiming adjustments smoothly without jerks or glitches encountered in standard putter bottoms.

Figure 9:
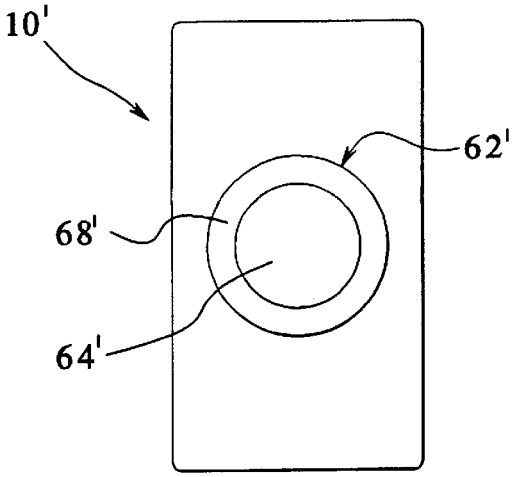
FIG. 9 is a sole or base view of a putter having a continuously circular sole sensor.
Figure 10:
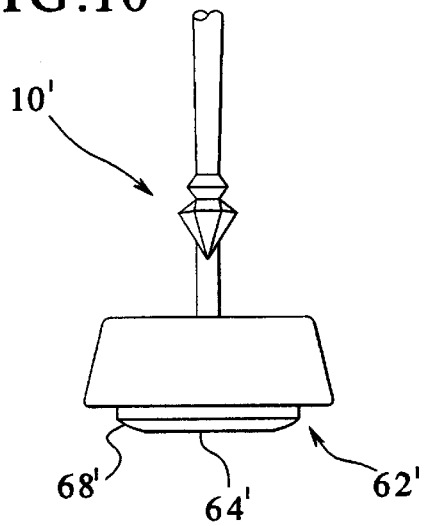
FIG. 10 is a toe or side view of the putter of FIG. 11.

Another embodiment is shown in FIGS. 9 and 10, wherein a putter 10' has a completely circular sole sensor 62', with a continuous spherical edge 68' and a flat surface 64'.

The flat surface 64, 64' of the sole sensor 62, 62' is preferably approximately 1 inch in diameter. Moreover, the spherical radius shape of the edges of the sole sensor 62 can be designed to correspond with a sighting or visual alignment system on the top 76 of the putter head 12.

The visual alignment system is shown in FIGS. 1, 2, 3, and 5. The top 54 has a stepped-up shape, with multiple surfaces at various vertical heights. Generally, the top housing 54 includes the swale 76 and arch 77 immediately rearward of the plate 14, a rear upper surface over the top of the flange, and a raised sloping sight-line step 74 that extends rearward below the top line arch 77 and back from the rear wall 75. The center of the arch 77 is higher than the center of the swale 76, and the arch 77 is vertically higher than the sloping step 74, which is vertically higher than the surface 78 of the flange channel 52.

The concave swale 76 is formed in the housing top 54 in the front upper surface immediately rearward of the face plate 14. This swale 76 is generally centered and forms a short, semicircular, concave channel extending perpendicularly rearwardly from the striking face. This swale 76 has a preferred width (along the heel to toe direction) of 1.800 inches, slightly wider than the diameter of a golf ball. The downwardly-curving arch 77 defines a rear of the swale 76 and generally forms a high point of the putter head 12.

The channel bottom surface 78 extends over the rear flange and aligns with the swale 76, i.e. it is centered and parallel relative to the to striking direction. Also, the flange channel 78 is approximately the same width as the diameter of a golf ball. A central arch sight line 80, which may be recessed or raised, extends along the striking direction, centrally over the arch 77 and rounded flange step 52, and preferably also through the center of the swale 76 and flange channel 78, as illustrated.

The slots 110, 111 are in alignment with the flange channel 78. The slots 110, 111 are parallel to the ball path and at right angles to the face 16. These slots 110, 111 also border the outside edges of the ball width and parallel the center line and sloped sight boss 114. The swale slots 112, 113 and the arched sight line 81 is parallel to the ground. Only the sloped center line 81 enclosed in the sloped sight boss 114 at a right angle or weak right angle to the face plate 16.

Figure 11:
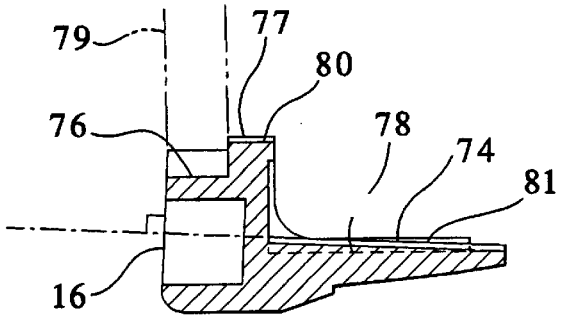
FIG. 11 is a sectional view taken substantially along lines XI—XI of FIG. 3.

Turning to FIG. 11, it will be noted that the sloped right boss 74, the sight line 81 is or heavily is perpendicular to the striking face 16 despite the fact the striking face 16 has a loft. Thus, the sight line 81 and slope sight boss 74 are not perpendicular to a vertical line (see 79), but to the plane of the striking face 16. The inventor has found that this perpendicular relationship to the striking face 16 is important in obtaining correct alignment and putting accuracy. In contrast, conventional sight lines which are only perpendicular to the vertical (see line 79) result in less ease of alignment and less accurate aim.

In a preferred embodiment, the rounded circular edge 68 of the sole sensor 62 (FIG. 4) has a spherical contour with an outer contour radius 69 of approximately 0.800 inches on an inner border radius 67 of approximately 1.125 inches. This dimensional relationship of the sighting system with the putter sole allows the golfer to visually see and physically sense grounding feedback from the sole sensor 64, 62. As a result, a golfer can adjust the face loft and lie angles for better alignment and greater aiming accuracy.

The visual alignment system enhances a golfer's ability to precisely aim a golf ball 82 (FIG. 2). The swale 76 has a low point which is preferably approximately 0.850 inches above the sensor flat surface 78, and the low point of the swale 76 is also approximately 0.010 inch above an equator of the ball 82 when both the putter 10 and ball 82 are resting on the green, as shown in FIG. 2. This dimensioning maximizes correct centering of the ball when aligning during setup, however, other dimensions are possible. Of course, when a golfer is to actually putt, the putter is slightly lifted from the ground, automatically elevating the putter to strike the ball 82 at a "sweet spot" of the striking face 14 which, in an embodiment, is directly adjacent and aligned with the adjustable weight 22 (FIG. 1).

Figure 5:
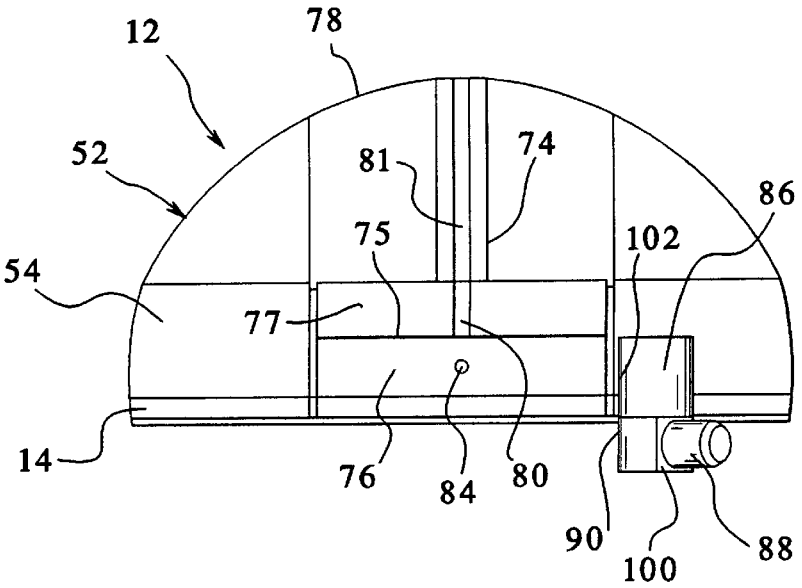
FIG. 5 is a plan view of the putter of FIG. 2.

When a golfer's eyes are correctly over the ball, i.e., looking vertically downward, the sight lines 80, 81 appear aligned and straight. Such a view is illustrated in FIG. 5. If the golfer's eyes are past the ball or short of plumb, the separated sight lines 80, 81 appears broken offset, or stairstepped, warning the golfer that setup adjustments should be made.

The mass of putter head contacts the ball slightly below the equator causing minimum lofted skip, maximum gearing rotation thus optimum ball rotation creating a straight true roll.

Moreover, the widths of the flange channel 78 being nearly the same as the width of a golf ball, visually enhance a golfer's ability to aim accurately. Further, a center dot 84 is located at a low point in the swale 76, also contributes to aiming and aligning accuracy. The dot 84 may be raised or recessed.

The adjustable hosel can be provided with various fixed lies or with the adjustable cam-loc-lie mechanism. Either embodiment gives an optimum custom fit to an individual golfer, facilitating easier alignment, aim and accuracy. To this end, a rectangular bar forms the first hosel section 86 which extends generally upwardly from the putter head 12. A horizontal rod-shaped cylindrical member 102 is connected to the second hosel section 88 and includes a flat front surface 100. The surface 100 is dispose substantially parallel to the face plate 116 to, again, promote proper alignment. When the putter 10 is soled correctly, the horizontal sections 102 and 103 are disposed parallel to the ground. The second hosel member 88 is configured to lead the hands through the stroke, creating a "trailor effect". Thus, the hosel 90 is designed to enhance visual alignment and therefore putting accuracy.

Referring to FIGS. 1–6, the putter 10 is shown with an adjustable-lie hosel. The hosel 90 includes a first hosel member 86, preferably shaped as an elongated square or rectangular bar, extending vertically upwardly from the putter head 12. The hosel also includes the second hosel member 88 to which the putter shaft 36 is secured (FIG. 1). The second hosel stem 88 is selectively and pivotally securable to the first hosel member 86 at an adjustable hosel joint 90.

As shown in FIGS. 1 and 5, the first hosel member 86 is connected to the housing and set back to allow unobstructed viewing of the sight lines 80, 81. Also, the second hosel member 88 is preferably center-aligned with a center point central in a low point of the swale 76.

Figure 7:
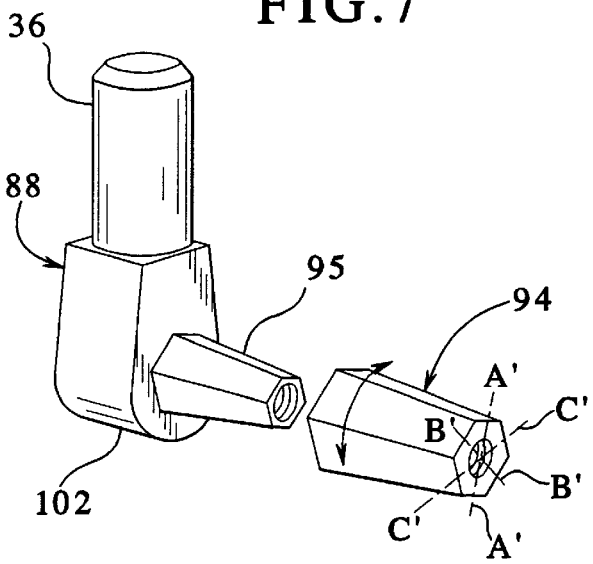
FIG. 7 is a perspective view of the second hosel member having a tapered pin and cooperating cam lock sleeve.
Figure 8:
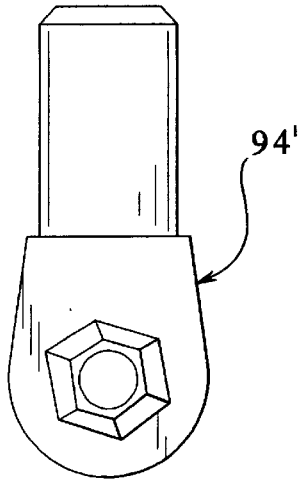
FIG. 8 is an end view of the second hosel member first shown in FIG. 7.

As illustrated in FIG. 8, the joint 90 includes a shaped bore 92 in the first hosel member 86 (FIGS. 1 and 6). A cooperatively shaped tapered sleeve 94 fits onto a cooperatively shape projection 95 on the second hosel member 88. Both the sleeve 95 and projection 94 fit in the bore 92 at one of a plurality of angles indicated at A', B' and C' in FIG. 7. The pivotable motion is indicated by the arrows C in FIG. 2. The tapered sleeve 94 is shaped to snugly fit within the tapered bore 92 and onto the tapered projection 95 to produce a strong compression-friction bind between the first and second hosel sections 86, 88. A screw 96 is arranged in an end of the projection 95 to tighten the fit between the projection 95, the sleeve 94 and the bore 92. The screw 96 is preferably of an allen or TORX™ type, having a recessed multi-sided slot.

Referring to FIG. 7, it will be noted that in the embodiment shown in FIG. 7, the sleeve 94 and the projection 95 both have tapered, irregular hexagonal shapes. As a result, each element includes three pairs of opposing faces. Referring to the sleeve 94, the pairs of opposing faces are indicated at A'—A', B'—B' and C'—C'. When mounted onto the projection 95 and inserted into the shaped bore 92 (FIGS. 1 and 6), the sleeve permits the lie angle of the putter, or the angle between the shaft 36 and the first hosel section 86, to be one of three different angles, those angles being represented by A'—A', B'—B' or C'—C'. For example, the sleeve 94 shown in FIG. 7 may be a sleeve which permits lie angles of 10°, 11° or 12°. To adjust the lie angle of the putter, the screw 96 (FIG. 6) is removed and the second hosel section 88 pulled out of the first hosel section 86. The sleeve 94 is removed from the sleeve 95 and rotated either clockwise or counterclockwise one surface A', B' or C' to adjust the lie angle of the putter 10. It is preferred that each sleeve 94 provided with the putter 10 permit lie angle adjustments in 1° increments. Thus, if hexagonal sleeves 94 are used, four sleeves could be provided thereby permitting a lie angle range of the putter from 10° to 22° (each sleeve permitting 3° of variance).

During the lifetime of the putter, the lie angle may be easily adjusted by removing the screw 96 (FIG. 6) and pulling the hosel member 88 out from the hosel member 86. If desired, the joint 90 may be heated to facilitate removal of the member 88 from the member 86 and to further facilitate removal of the sleeve 94 from the projection 95. The adjustment process is then repeated by rotating the sleeve 94 to a different angle (A', B' or C') or by replacing the sleeve 94 with a different sleeve or by rotating the sleeve 94.

The adjustable hosel allows a golfer to custom-set the lie angle between the vertical hosel member 86 and square to radial hex taper pin 88 at virtually any angle, but a setting between shaft stem 14° to 24° is typical.

The second hosel member 88 has a flat surface 100 facing forwardly, creating a visually square effect, enhancing proper alignment and aiming accuracy, as shown in FIGS. 1, 2, 5, and 6. In an embodiment, the flat face 100 of the hosel joint 90 physically and visually lines up plumb to a line between a rear or front edge of the face plate 14 and the putter head 12 as a golfer looks downward. However, embodiments are possible where this flat face 100 is more forwardly or rearwardly located, or plumb-alignable with a different selected point on the putter 10, such as with the front edge of the plate 14, or an edge of the first hosel member 86, etc.

Also, the hosel provides that the elongated bar-like first hosel member 86 has a square or rectangular cross section which extends vertically upward, at a right angle to the putter head 12 and perpendicularly to the ground plane. The normally-oriented and rectangular sides of the first hosel member 86 give a further squaring effect which assists a golfer in aligning and aiming.

Another feature of the hosel is a cylindrically-shaped section 102 curving under the hosel joint 90. This cylindrically shaped section 102 has a side which aligns parallel to the sight lines 80, 81, to the swale 76, channel 78, and ground 66. This feature also assists a golfer in achieving correct aligning and aiming.

An embodiment of the invention incorporating the hosel features may be provided as a fixed-lie putter, rather than the adjustable-lie hosel discussed above. This fixed-lie embodiment may be provided in various fixed lies as needed for particular golfers.

It should be understood that various changes and modifications will be apparent to those skilled in the art. Such changes and modifications may be made without departing from the spirit and scope of the invention and without diminishing its attendant advantages. For example, the edge 68, 68' might be nonspherical or beveled in shape. The first hosel section or shaft 86 may be offset from the plane of the face plate 16 while the taper pin chamber or housing 90 still abuts the plane of the face plate 16 so that the hosel section 86 is not vertical but angled forwardly towards the plane of the face plate 16 as it extends up to the housing 90. Therefore, such appended claims are intended to cover such changes and modifications.

What is claimed is:

1. A variable-loft, variable-weight golf putter kit comprising:

a) two or more interchangeable striking face plates, each plate defining a striking face and a substantially flat rear face, wherein at least two of the striking face plates have different striking face lofts;

b) a putter head to which a selected one of the striking face plates is removably securable with at least two screws having heads which fit flush with the striking face;

c) at least one removable weight for adjusting the weight of the putter; and d) a cavity in the putter head sized to receive said weight, the cavity being covered when one of said striking face plates is secured to said putter head;

e) each said striking face plate carrying on its rear face a peg of substantially polygonal cross section, said weight having a corresponding substantially polygonal recess formed partially therethrough and being sized to engage said peg so as to secure said weight against rotation with respect to said striking face place, said weight being mountable on said peg with a screw.

* * * * *